United States Patent [19]

Migliorati

[11] 4,238,114

[45] Dec. 9, 1980

[54] ROCKING PLATFORM FOR THE POSITIONING OF VEHICLES ABOVE GROUND LEVEL

[76] Inventor: Pier I. Migliorati, 5, Corso Italia, Alba, province of Cuneo, Italy

[21] Appl. No.: 43,798

[22] Filed: May 30, 1979

[30] Foreign Application Priority Data

Jun. 6, 1978 [IT] Italy ..... 68297 A/78

[51] Int. Cl.[3] ..... B66F 7/22

[52] U.S. Cl. ..... 254/88; 187/8.43; 254/94

[58] Field of Search ..... 187/8.43, 8.41, 8.67; 254/88, 90, 94

[56] References Cited

U.S. PATENT DOCUMENTS

| | | | |
|---|---|---|---|
| 2,836,261 | 5/1958 | Neilson | 187/8.43 |
| 3,048,237 | 8/1962 | Rutherford | 187/8.43 |

FOREIGN PATENT DOCUMENTS

| | | | |
|---|---|---|---|
| 695900 | 10/1930 | France | 254/88 |
| 385451 | 3/1965 | Switzerland | 254/88 |

*Primary Examiner*—Robert C. Watson

*Attorney, Agent, or Firm*—Lowe, King, Price & Becker

[57] ABSTRACT

The rocking platform for the positioning of vehicles above ground level comprises a supporting structure for sustaining a pair of parallel longitudinal rails which define the vehicle loading surface. The supporting structure presents a cradle-shaped base having the form of a dihedron with the convexity directed towards the ground. The cradle-shaped base is formed by two bearing planes, one of which is parallel to the loading surface, while the other is inclined with respect thereto. The rails extend, with access extremities, for a substantial length above and beyond one extremity of the parallel bearing plane in the direction of the inclined bearing plane. The platform is rockable from a horizontal position, in which the supporting structure rests on the parallel bearing plane, to an inclined position in which the supporting structure rests on the inclined bearing plane. In the inclined position of the platform the vehicle is caused to move up along the access extremities of the rails, until it promotes the rocking of the platform when the common barycenter of vehicle and platform passes beyond the fulcrum axis defined by the edge of the dihedron.

12 Claims, 7 Drawing Figures

ROCKING PLATFORM FOR THE POSITIONING OF VEHICLES ABOVE GROUND LEVEL

SUMMARY OF THE INVENTION

The present invention relates to a rocking platform for the positioning of loads, and particularly of wheeled vehicles, above the ground level. The rocking platform according to the invention is particularly useful whenever it is required to effect repair and maintenance servicing of automobiles, and this servicing implies the positioning of the vehicle at a certain height above the ground level, either for technical necessity, or for commodity of the user who effects the servicing.

There are known vehicle hoisting apparatuses which generally employ hydraulically or mechanically operated lifting platforms, which are used in service stations, garages and the like. This apparatuses however, besides being costly, require maintenance, and present the inconvenience of usually being mounted stationary in the garage or other place where they are needed.

According to the present invention, there is provided a platform for the positioning of vehicles above ground level which is very simple and rugged in its construction and operation, does not employ any motor- or hydraulic-operated devices, is of low cost, and can be safely used by non-specialized personnel, such as for example the owner of the vehicle (automobile) who desires to effect the servicing of same on a do-it-yourself basis, and of course is not willing to buy and install permanently an expensive apparatus for an occasional repair or servicing work.

According to the invention, the rocking platform for the positioning of vehicles above ground level comprises a supporting structure for sustaining a pair of parallel longitudinal rails which define the vehicle loading surface. The supporting structure presents a cradle-shaped base having the form of a dihedron with the convexity directed towards the ground. The cradle-shaped base is formed by two bearing planes, one of which is parallel to the loading surface, while the other is inclined with respect thereto. The rails extend, with access extremities, for a substantial length above and beyond one extremity of the parallel bearing plane in the direction of the inclined bearing plane. The platform is rockable from a horizontal position, in which the supporting structure rests on the parallel bearing plane, to an inclined position in which the supporting structure rests on the inclined bearing plane. In the inclined position of the platform the vehicle is caused to move up along the access extremities of the rails, until it promotes the rocking of the platform when the composite center of gravity of vehicle and platform passes beyond the fulcrum axis defined by the edge of the dihedron.

In order to perform an easy loading operation of the vehicle onto the platform rails, the rails are provided, adjacent their access ends, with loading ramps hinged thereto. The said loading ramps, in the horizontal position of the platform, are swung down so as to bear onto the ground with their free ends, and are locked in this downwardly swung position, thus providing for a safety device which avoids any accidental, undesired tilting of the platform when the vehicle is loaded thereonto.

As a further feature of the invention, the platform is provided, in correspondence of its base, with retractable wheels, which thus permit the easy displacement of the platform to any place where it is required.

Still as a further feature of the invention, an accessory is provided which consists of a footboard which can be removably secured to the platform sides, at the level of the vehicle supporting rails, whenever the user needs to effect some work at this level.

Moreover, another accessory may be provided which consists in an adequate number of upright supporting posts which can be arranged in correspondence of the space between the parallel rails, which posts are intended to support the vehicle in a lifted position with respect to the said rails, for example whenever the servicing operation requires the taking off of at least one wheel of the vehicle loaded on the platform.

The above and other features of the invention, and the advantages deriving therefrom, will appear evident from the following detailed description of a preferred embodiment.

DESCRIPTION OF THE PREFERRED EMBODIMENT

Figure 1:
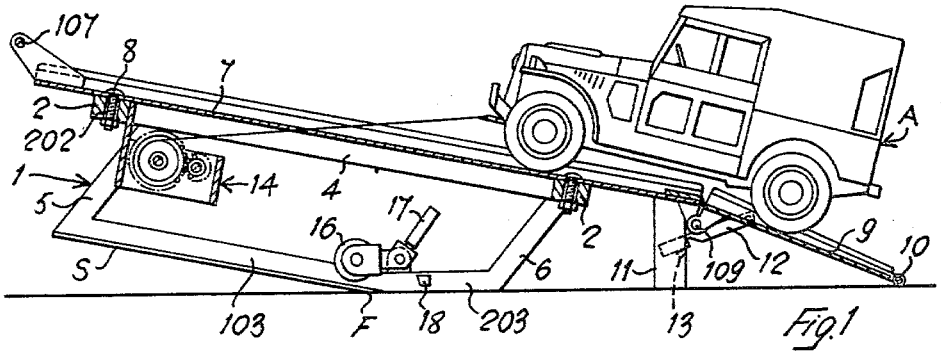
FIG. 1 is a side elevation, with parts in section, of the loading platform according to the invention, in its inclined or loading position.
Figure 2:
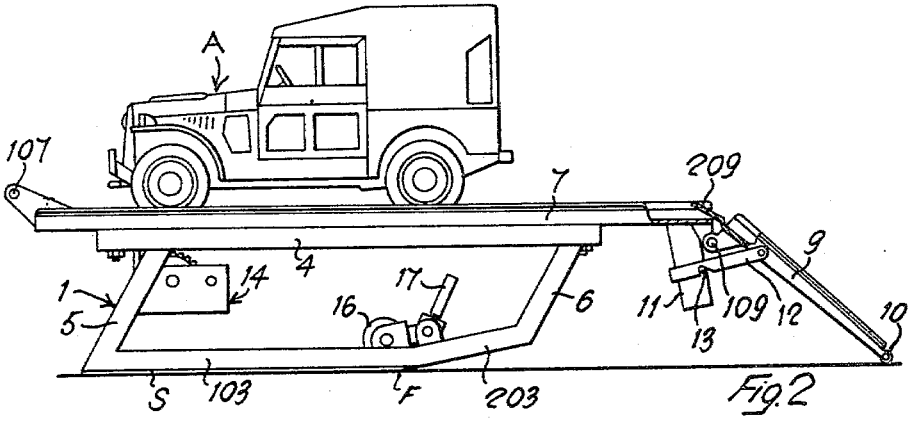
FIG. 2 is a side elevation of the platform of FIG. 1, in its horizontal or loaded position.
Figure 3:
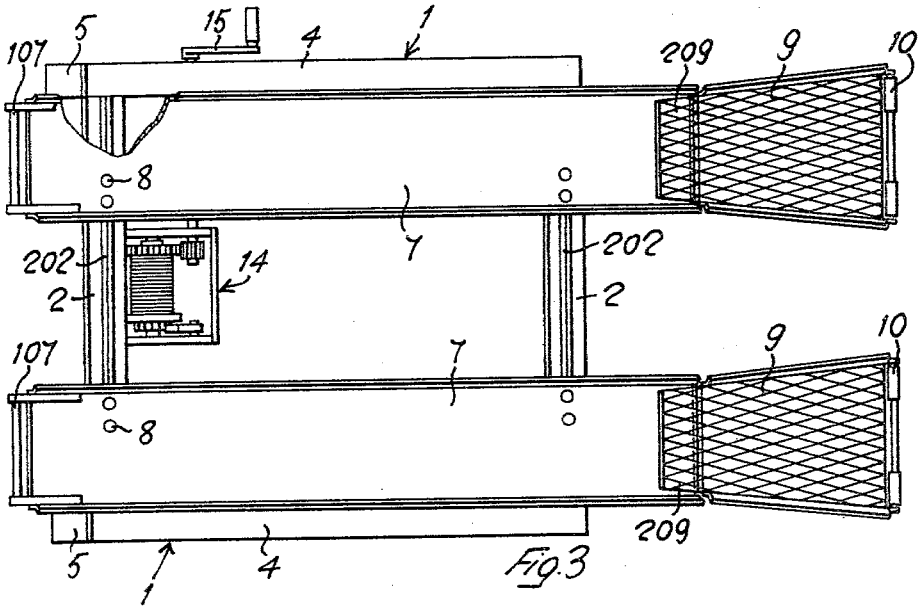
FIG. 3 is a top plan view of the platform.

With reference to the drawings, and particularly to FIGS. 1 to 3, the rocking platform according to the invention consists of a supporting steel structure means comprising two longitudinal side frame members 1 which are connected by means of upper transversal crosspieces 2. Each longitudinal side frame member 1 consists of a base angle beam 103-203 which precisely presents two rectilinear sections 103, 203 defining an angle presenting its convexity directed towards the ground onto which the said base beam bears. The line passing through the vertexes of the said angles of both base beams 103-203 of the two frame members 1 defines the axis of the fulcrum F around which the rocking platform can oscillate, as it will be seen herein after. Practically, the two base angle beams 103-203 delimit a cradle-shaped base for the rocking platform, which base can be compared to a dihedron defined by one plane delimited by the rectilinear sections 103 and by another plane delimited by the rectilinear sections 203, said planes meeting at the edge F. As it can be appreciated from the drawings, the section 103 of the base beam (which will be termed as "parking section" due to the fact that it is the section which actually rests on the ground when the vehicle has been loaded onto the platform and is parked for the repair works) is substantially longer than the adjoining section 203 (which will be termed as "loading or access section" due to the fact that it is the section which bears on the ground during the loading operation of the vehicle onto the platform).

Positioned at the extremities of the base angle beam 103-203 of each frame member 1 are upwardly directed struts 5, 6 which sustain the supporting top beam 4, which is parallel to the parking section 103 of the said base beam and is situated at a suitable height with respect thereto.

On the upper crosspieces 2 there are secured (substantially in correspondence of each top beam 4) a pair of longitudinal vehicle-wheel supporting rails 7 which define the proper loading surface means onto which the vehicle is loaded. The distance between the said rails 7 can be adjusted depending upon the distance between the vehicle wheels, and for this purpose, as it appears from FIGS. 1 and 3, the crosspieces 2 connecting the frame members 1 adjacent the top beams 4, present a slot 202 through which pass the fastening bolts 8 which traverse corresponding through bores formed in the rails 7. The adjustment of the distance between the two rails 7 is therefore simple and evident. It is to be noted, however, as it appears from FIG. 3 of the drawings, that each rail 7 presents a fairly ample width which therefore allows the loading of vehicles presenting slight differences in the distance between the wheels, without the need of any adjustment.

Adjacent the extremity of each rail 7, above the loading section 203 of the base beam, there is hinged, at 109, a loading or access ramp 9, to allow swinging from a position at which the ramp is substantially aligned, or it presents a very small inclination with regards to the respective rail 7 (see FIG. 1), to a position (see FIG. 2) at which it is downwardly inclined at a substantial angle with respect to the rail 7. The loading ramps 9 present, adjacent of their extremity hinged to the rails 7, a short extension 209 which serves as alignment member for the ramp 9 with respect to the rail 7, and as a bridging section for permitting the smooth rolling of the wheels of the vehicle across the hinge joint between the rail 7 and the ramp 9. Each loading ramp 9 is provided, at its other or free end, with at least one roller 10, for permitting the free movement of the said end on the ground, particularly during the unloading operation, as it will be described later.

Adjacent the loading or access end of the rails 7, there is further provided a downwardly directed supporting leg 11, the height of which is calculated in such a manner that the said leg 11 comes to rest on the ground in the inclined, loading position of the rocking platform (FIG. 1), thus furnishing an additional support adjacent the hinge point 109. A very simple locking device, which consists of a locking bar 12, hinged to each loading ramp 9 and provided with a notch adapted to engage a locking pin 13 provided on the legs 11, permits the locking of the loading ramps 9 in the downwardly inclined position in order to stabilize the platform with the rails 7 arranged horizontal and the vehicle loaded thereon, as shown in FIG. 2.

A winch 14, which can be operated through a handle 15, is suitably arranged adjacent the end of the platform opposite to the loading or access end, for the towing of vehicles without engine, or with an inoperative engine.

The operation of the just described rocking platform is simple and evident. Firstly, it is to be noted that the dimensioning and arrangement of the various components of the platform is calculated preferably in such a manner that the platform normally assumes its inclined position, as shown in FIG. 1, that is with its center of gravity falling beyond the fulcrum F in the direction of the loading ramps 9. The platform therefore rests on the ground with the loading sections 203 of the base angle beams 103-203 and, with the supporting feet 11 engaging the ground, and with the rollers 10 extended so that the loading ramps 9 are in their position of substantial alignment with the rails 7.

In this condition, the vehicle A (usually an automobile) is caused to advance on the platform, either self-propelled (by its own engine) or towed by the winch 14 through a suitable cable. The vehicle advances on the platform, with its wheels rolling up the loading ramps 9 and on the rails 7, until the composite center of gravity of the platform and of the vehicle supported thereby, is shifted beyond the fulcrum F in the direction of the parking section 103 of the base angle beam. The shifting of the center of gravity causes the rocking of the platform until said parking sections 103 rest on the ground, and the rails 7 (and vehicle resting thereon) are brought to a horizontal position (FIG. 2). In order to attenuate or dampen the impact of the parking sections 103 of the base beams on the ground, each parking section 103 is provided on its undersurface with a sole S made of rubber or any other suitable elastic or shock-absorbing material.

While the platform oscillates to its horizontal position of FIG. 2, each loading ramp 9 moves progressively upwardly to form an angle with the rail 7, by the free end rolling on the ground with the roller 10, until the ramp is automatically (or manually) locked in the position shown in FIG. 2, by the cooperation of the locking bar 12 and the pin 13 provided on leg 11. In this manner, it is positively ensured that the platform cannot be tilted again to its inclined position, unless the locking bar 12 is released from the pin 3. This safety feature prevents any accidental tilting of the platform due to an undesired backward movement of the vehicle A on the rails 7.

For further safety and stability of the loaded platform, the vehicle A is further moved along the rails 7 until the common center of gravity lies well beyond the fulcrum F, in the direction of the parking section 103 of the base beam. Still as a further safety measure, in order to prevent any accidental falling of the vehicle from the platform, due to undesired forward or backward movements, adjacent the ends of the rails 7 opposite to the loading ramps 9, there are provided suitable abutment stops 107 for the vehicle wheels, while the upwardly lifted extensions 209 of the inclined ramps 9 (see FIG. 2) serve also as abutment stops adjacent the ramp ends of the rails 7.

In order to move the vehicle out of the platform (unloading operation) it is sufficient to disengage the locking bars 12, and to promote the slow rearward movement of the vehicle A on the rails 7 back in the direction of the ramps 9. As soon as the common center of gravity of the vehicle and platform is again moved beyond the fulcrum F, in the direction of the ramps 9, the platform rocks around the fulcrum F to its inclined position (FIG. 1) and it is possible to cause the descent of the vehicle down along the said ramps 9, until it reaches again the ground.

It is to be noted that preferably the venicle should be loaded onto the rocking platform with its heaviest portion forward (in the example as shown, the engine) since this favours the prompt rocking of the platform and a stable horizontal positioning with the vehicle loaded thereon.

In order to move the unloaded platform from one place to another, there are provided (as it appears from FIGS. 1 and 2) a pair of wheels 16, one for each frame member 1, adjacent the fulcrum angle F of the base beam 103-203. The wheels are mounted retractable in any suitable manner. In the example illustrated, the wheels 16 are mounted on a rocking lever 17 which can be swung from an inactive (retracted wheel) position, illustrated in the Figures, to an active (outward) position at which the wheels 16 bear onto the ground. A suitable abutment stop 18 (FIG. 1) is provided on the base beam for limiting the swinging movement of the lever 17 and maintaining the wheel in operative position. With the wheels 16 in their outward operative position, the platform can be easily moved either by pushing or by pulling.

Figure 4:
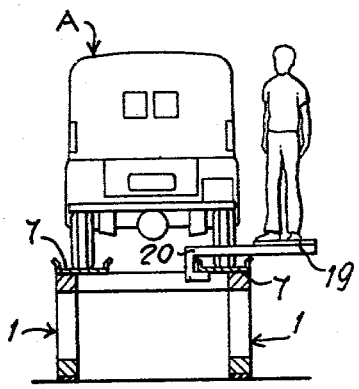
FIG. 4 is a diagrammatic end view, with parts in section, of the platform provided with the footboard accessory.
Figure 5:
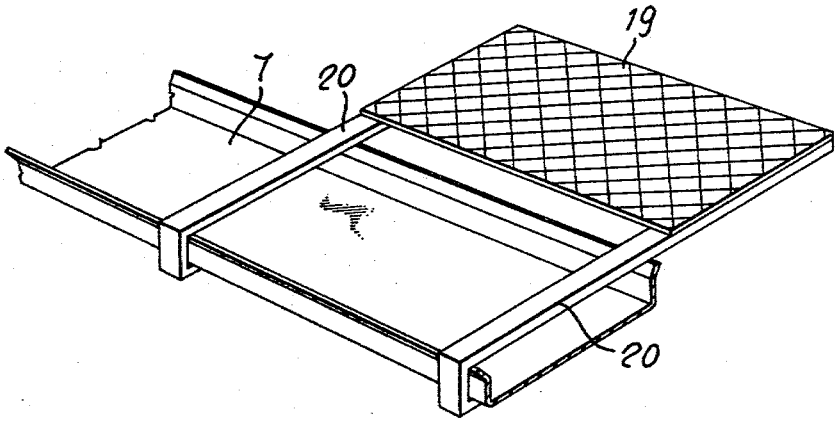
FIG. 5 is a perspective view of a detail showing the footboard as applied to the platform.

FIGS. 4 and 5 illustrate a useful accessory which may be used in connection with the rocking platform according to the invention when it is desired to work at the same level of the lifted vehicle. The accessory consists of a footboard 19 which is provided with two hook-ended attaching arms 20 which can be secured, in an easily removable manner, to one of the rails 7 of the platform.

Figure 6:
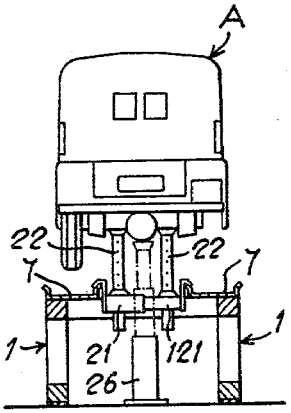
FIG. 6 is a diagrammatic end view, with parts in section, of the platform provided with the supporting posts.
Figure 7:
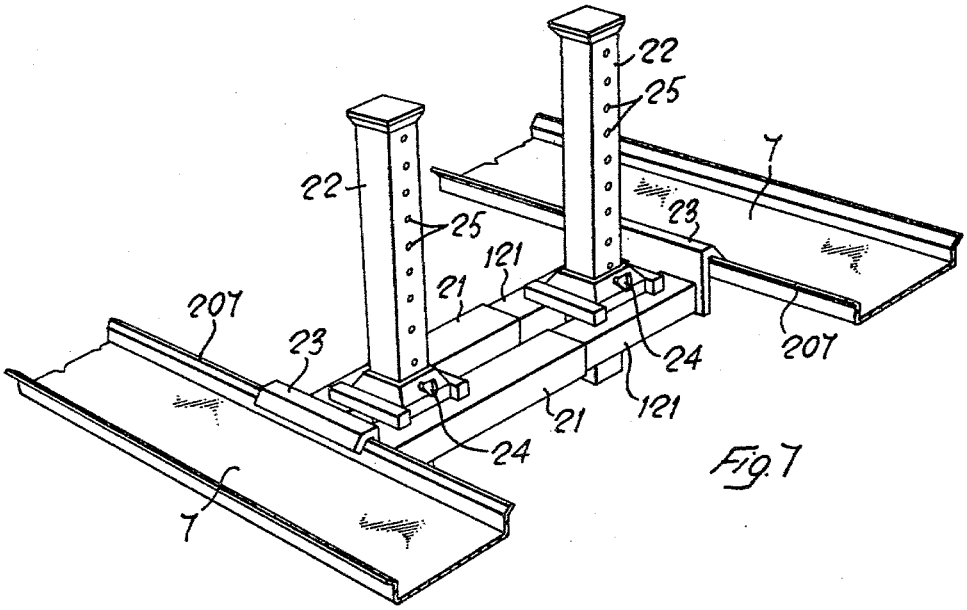
FIG. 7 is a perspective view of a detail showing the supporting posts as applied to the platform.

Still another accessory is illustrated in FIGS. 6 and 7. The said accessory may be used whenever it is desired to maintain the vehicle in a lifted position with respect to the platform rails 7, for any servicing purpose, for example when the repair operation requires removing one or more wheels of the vehicle. The accessory consists of a transverse telescopic supporting bar 21-121 which can be easily adapted to the existing distance between the two rails 7 and is mounted thereon by means of hook-shaped end plates 23 which engage the raised projecting edge 207 of the rails. On the transverse bar 21-121 there are provided the upright posts 22 which can be adjusted in height by means of locking pins 24 engaging bores 25 provided in the said upright posts 22. As it clearly appears from FIG. 6, a car-jack 26 of any suitable type is used to lift the vehicle A at the desired height above the plane of the rails 7, then the upright posts 22 are adjusted so as to support the car in a stable manner. Thereafter, the car-jack 26 may be removed, since the vehicle will be supported by the posts 22.

It is believed that the invention will have been clearly understood from the foregoing detailed description of a preferred embodiment. Changes in the details of construction may be resorted to without departing from the spirit of the invention, and it is accordingly intended that no limitation be implied and that the hereto annexed claims be given the broadest interpretation to which the employed language fairly admits.

I claim:

1. A rocking platform for the positioning of loads, and more particularly of vehicles, above ground level, comprising loading surface means, supporting structure means for said loading surface means, said supporting structure means including a cradle-shaped base with the convexity directed towards the ground, said cradle-shaped base presenting two bearing plane means, one of said bearing plane means being parallel to said loading surface means, said one bearing plane means extending over a substantial distance across the ground, the other bearing plane means being inclined with respect thereto; said loading surface means extending adjacent the access end for a substantial length above and beyond said parallel bearing plane means in the direction of the said inclined bearing plane means, said platform being rockable from a horizontal position, in which said supporting structure means rests on the ground on the bearing plane means which is parallel to the loading surface means, to an inclined position in which said supporting structure means rests on the ground on the inclined bearing plane means, the bearing plane means parallel to the loading surface means presenting a length which is greater than the length of the inclined bearing plane means, whereby the stability of said platform is enhanced when a vehicle is positioned on said loading surface means and the load is extended over a substantial area of the ground.

2. A rocking platform according to claim 1, in which the cradle-shaped base of the supporting structure means defines a dihedron formed by said two bearing planes means and the edge of the dihedron constitutes the fulcrum axis around which the rocking platform can oscillate with respect to the ground.

3. A rocking platform according to claim 1, in which the supporting structure means comprises a pair of longitudinal side frame members connected by means of transverse crosspieces, each side frame member including a pair of base angle beams comprising two rectilinear sections forming an angle with the convexity directed towards the ground, the line passing through the vertexes of the said angles defining the fulcrum axis of the platform.

4. A rocking platform according to claim 2, in which the loading surface means comprises a pair of longitudinally arranged, spaced apart parallel rails.

5. A rocking platform according to claim 4, in which is provided adjustable means for mounting said parallel rails on the supporting structure means so as to be adjustably movable in the transverse direction independently of said base, and means being provided for fastening said rails at a predetermined distance between each other.

6. A rocking platform according to claim 5, in which adjacent the access end of each rail there is hinged a downwardly swingable loading ramp, said ramp constituting an extension of the said rail.

7. A rocking platform according to claim 6, in which means are provided to lock the loading ramps in their downwardly swung position, at which position the free ends of the said ramps bear onto the ground while the platform is in its horizontal position.

8. A rocking platform according to claim 6, in which downwardly directed supporting legs are provided adjacent the access ends of the rails, said supporting legs extending for such a length as to bear on the ground whenever the platform is in its inclined position.

9. A rocking platform according to claim 6, in which each loading ramp presents, adjacent the end which is hinged to the rail, an extension which in the upwardly swung position of the ramp abuts and lies over a portion of the end of the rail, while in the downwardly swung position of the rail it constitutes a wheel abutment stop projecting upwardly with respect to the rail surface.

10. A rocking platform according to claim 4, in which a footboard is provided, arm means extending across one of said rails for removably fastening said footboard sidewise of said loading surface means adjacent the level of the loading surface.

11. A rocking platform according to claim 1, in which vehicle supporting posts adjustable in height are provided, a pair of transverse telescoping bars carried by the loading surface means for supporting said posts, said posts projecting above said loading surface means.

12. A rocking platform according to claim 3, in which retractable wheels are provided adjacent the fulcrum axis between said base angle beams on the base of the supporting structure means.

* * * * *